313-422 SR
12/10/85 XR 4,558,255

United States Patent [19]

Genovese et al.

[11] Patent Number: 4,558,255

[45] Date of Patent: Dec. 10, 1985

[54] EDGE-OUT MATRIX LIGHT BAR COUPLING APPARATUS AND METHOD USING A FIBER-OPTICS PLATE

[75] Inventors: Frank C. Genovese, Fairport; Joel M. Pollack, Rochester, both of N.Y.

[73] Assignee: Xerox Corporation, Stamford, Conn.

[21] Appl. No.: 605,730

[22] Filed: May 1, 1984

[51] Int. Cl.[4] ..... H01J 1/62; H01J 63/04

[52] U.S. Cl. ..... 313/497; 313/495; 313/422; 350/96.24; 250/227

[58] Field of Search ..... 350/96.27, 96.24; 313/475, 474, 422, 470, 495, 496, 497; 250/227

[56] References Cited

U.S. PATENT DOCUMENTS

| | | | |
|---|---|---|---|
| 3,303,374 | 2/1967 | Fyler | 313/92 |
| 3,589,795 | 6/1971 | Miyazaki et al. | 350/96.27 |
| 3,628,080 | 12/1971 | Lindeqvist | 315/9 |
| 3,728,422 | 4/1973 | Sugaya | 350/96.24 |
| 3,840,701 | 10/1974 | Tomii et al. | 178/7.2 |
| 3,887,724 | 6/1975 | Diakides | 427/6.4 |
| 3,907,403 | 9/1975 | Maeda | 350/96.13 |
| 4,033,687 | 7/1977 | Hirayama et al. | 355/1 |
| 4,134,668 | 1/1979 | Coburn | 355/3 R |
| 4,139,261 | 2/1979 | Hilsum | 350/96.27 |
| 4,141,642 | 2/1979 | Nagai et al. | 355/1 |
| 4,227,117 | 10/1980 | Watanabe et al. | 313/422 |
| 4,291,341 | 9/1981 | Yajima | 358/300 |

FOREIGN PATENT DOCUMENTS 55-168961 12/1980 Japan .

OTHER PUBLICATIONS

Mini-Micro World/Mini-Micro Systems-May 1983, pp. 56, 58, 64.

1980 Futaba Corporation Catalog.

*Primary Examiner*—David K. Moore

*Attorney, Agent, or Firm*—William A. Henry, II

[57] ABSTRACT

A vacuum fluorescent printing device is disclosed having cathode filaments, a plurality of multiplexed control grids and a skewed matrix of addressable phosphor elements configured on a fiber optic plate in such a fashion as to enable light emitted from the phosphor elements to be directed edgewise through the fiber optic plate to expose a photosensitive member.

19 Claims, 8 Drawing Figures

EDGE-OUT MATRIX LIGHT BAR COUPLING APPARATUS AND METHOD USING A FIBER-OPTICS PLATE

Reference is hereby made to copending applications Ser. No. 605,728, entitled "Vacuum Fluorescent Printing Device", Ser. No. 605,729, entitled "Gated Grid Structure for a Vacuum Fluorescent Printing Device", and Ser. No. 605,731, entitled "Vacuum Fluorescent Printing Device Employing A Fly's-Eye Light Coupling Method", filed concurrently herewith and incorporated by reference to the extent necessary to practice the present invention.

This invention relates to a printing device for exposing a photosensitive member and, more particularly, to an active light bar which creates precisely controlled marks on a photosensitive member from a digital electronic bit stream that represents a document of which a copy is desired.

Typical medium-to-high quality electronic printing systems have resolutions of 300 pixels (picture elements) per inch or more. Usually, the resolution or pixel density is the same in both directions on the page, but this is not necessarily the case for all systems. Each bit of the electronic image is mapped to its appropriate pixel location on a grid that covers the page and defines the resolution of the system. The size of the mark that is made at each location depends on the particular marking process being used and may be smaller, but is usually larger, than the addressability of the system. For example, a round laser dot with a diameter of 1/300 inch may be used for exposure in a system with addressable elements arranged in a square array on 1/400 inch centers. With a raster scanner the information transfer is continuous, a bit at a time within each scan line being supplied, one line after another in linear succession. However in principle, the order of mapping pixels is perfectly arbitrary. The choice usually depends wholly on practical considerations.

For an active light bar of a given resolution, the printing speed fixes the maximum time available to make the exposure and the sensitivity of the photosensitive member determines the maximum output power required. For example, if 6 ergs/cm$^2$ is needed for proper exposure of the photosensitive member, a 10 inch width processed at 10 inches per second requires a minimum of 3871 ergs/sec or 0.387 milliwatts delivered to its surface. The process time per pixel mapped one-at-a-time at 300×300 per inch is only 111 nanoseconds.

When the system permits many points to be mapped simultaneously, these stringent time restraints are relaxed. Data processed in parallel can be handled by slower, less expensive logic and circuits in general are much easier to designed for low speed applications. The average power output of an individual element is reduced significantly when multiple elements can be used in parallel. The greater the number of sources that contribute to the net output, the greater the total available light and the longer the potential life of an individual element.

The following disclosures of various approaches to controlling display devices appear to be relevant:

U.S. Pat. No. 3,303,374
Patentee: Fyler
Issued: Feb. 7, 1967

Fyler discloses a cathode ray tube including a face plate comprising tapered fiber optical elements mounted in an opaque mosaic. Phosphor material is mounted on the inner ends of the elements, and means are provided for selectively directing an elecron beam onto the phosphor material.

U.S. Pat. No. 3,628,080
Patentee: Lindeqvist
Issued: Dec. 14, 1971

In Lindeqvist, a fiber optic face plate is disclosed for an electron tube in which an electron sensitive phosphor is provided on the inner surface of the face plate and the light image from the phosphor is viewed or coupled through the fiber optic face plate to an image intensifier. An electrical conductive coating is provided on the outer surfaces of the fiber optic face plate.

U.S. Pat. No. 3,840,701
Patentee: Tomii et al.
Issued: Oct. 8, 1974

Tomii discloses a fiber optics element for the image transmission system of a facsimile apparatus comprising a bundle of first and second groups of optical fibers. The first group of optical fibers is used for transmitting signal-modulated light for image recording purposes and the second group of optical fibers for non-modulated light for image sensing purposes.

U.S. Pat. No. 3,887,724
Patentee: Diakides
Issued: June 3, 1975

Diakides discloses a method of making a fiber optic phosphor screen having high contrast capability in which the phosphor layer is arrayed only over the elemental fiber cores and not over the area of the cladding material surrounding the fiber optic cores.

U.S. Pat. No. 3,907,403
Patentee: Maeda
Issued: Sept. 23, 1975

Maeda discloses a fiber-optics face plate for displaying an optical image of high image contrast that is suitable for visual observation under high intensity ambient illumination.

U.S. Pat. No. 4,033,687
Patentee: Hirayama et al.
Issued: July 5, 1977

Hirayama et al. discloses a cathode ray tube pickup device comprising a photosensitive medium having a dielectric layer, a photoconductive layer and conductive layer, a charger and discharger, an optical fiber tube closely spaced from the surface of the photosensitive medium to effect negative image application thereon, and developing means for developing the surface of the photosensitive medium with a toner opposite in polarity to the charge in said surface.

U.S. Pat. No. 4,139,261
Patentee: Hilsum
Issued: Feb. 13, 1979

Hilsum discloses a display panel construction comprising a plurality of addressable display panels each having a display zone for displaying visual information and arranged in a formation so as to collectively provide a composite display of increased area. A fiber optic image transform construction is arranged in front of the display panels for transforming an image collectively provided by the panels into a corresponding continuous image in which discontinuity between adjacent panel display zones is eliminated.

U.S. Pat. No. 4,141,642
Patentee: Nagai et al.
Issued: Feb. 27, 1979

Nagai et al. discloses an optical fiber cathode ray tube which enables the recording of images on the recording medium of a copying machine with a high resolution even if the recording medium is disposed with an increased gap between the tube and the recording medium to prevent mechanical contact therebetween. The tube is provided with an additional stack of optical fibers facing the optical fiber face plate of a cathode ray tube with a light transparent thin layer being interposed between the face plate and the additional stack.

In addition, Ricoh's Japanese Laid-Open Patent Application No. 55-168961/1980 filed under the title "Light Emission Recording Tube" discloses a light tube that is used to transmit light to a photosensitive member and the publication Mini-Micro World/Mini-Micro Systems of May 1983 on pages 56, 58 and 64 discloses a method of imaging with staggered arrays of recording heads. All of the aforegoing disclosures are incorporated herein by reference.

It is known that CRT's such as shown in U.S. Pat. Nos. 4,134,668 and 4,291,341 can be used in several configurations to generate xerographic images. They can be addressed rapidly and emit sufficient light to expose existing photoreceptors even at relatively high speed and still be gated within the available time. However, they are bulky and expensive and require complex support circuitry. The dynamics of electron-beam deflection makes it difficult to produce light patterns that are bright, very high in resolution, exactly rectilinear, and very stable in location, all at the same time.

An invention that addresses these problems is disclosed in copending U.S. application Ser. No. 605,729 entitled "Gated Grid Structure for a Vacuum Fluorescent Printing Device" which includes a support substrate in one aspect thereof on which skewed phosphor coated anode segments are positioned. Control grids are placed over the anode segments to gate emissions from cathode filaments spaced above the grids. The grid structure is arranged such a way that the voltages on row and column control lines must simultaneously be energized in order that electron beam current pass through the structure toward the anode. An equipotential screen placed between the anode and the grid structure is introduced to reduce the voltage swings required to operate the grid structure. A second screen is introduced between the filament and grid structure to reduce crosstalk effects between adjacent control lines on the grid structure. Electrons emitted from the cathode filaments pass through the first screen and are gated by control of the grid structure to pass through the second screen and excite the phosphor coated anodes to give off light that is transmitted to a photosensitive member by a fly's-eye lens. However, there is a continuing need to improve the light collection efficiency of print bars of this type.

Accordingly, in one aspect of the present invention, an improved compact vacuum fluorescent print bar is disclosed in which the display image is conducted by means of a fiber-optic plate to an adjacent photosensitive member in order to increase light collection efficiency further, and simultaneously remove the necessity to preformat the electronic image to be formed. The fiber-optic plate comprises a glass fiber-optic section thick enough to form part of the vacuum envelope with fibers aligned parallel to its surface.

In another aspect of the invention a thin glass fiber-optic layer with fibers aligned parallel to its surface is bonded to a thicker supporting sheet of light-absorbing glass.

In another aspect of the invention a light-pipe array is incorporated directly into the vacuum fluorescent device for light transmission purposes.

Further features and advantages of the invention pertain to the particular apparatus whereby the above-noted aspects of the invention are obtained. Accordingly, the invention will be both understood by reference to the following description and to the drawings forming a part thereof, which are approximately to scale, wherein.

Figure 1:
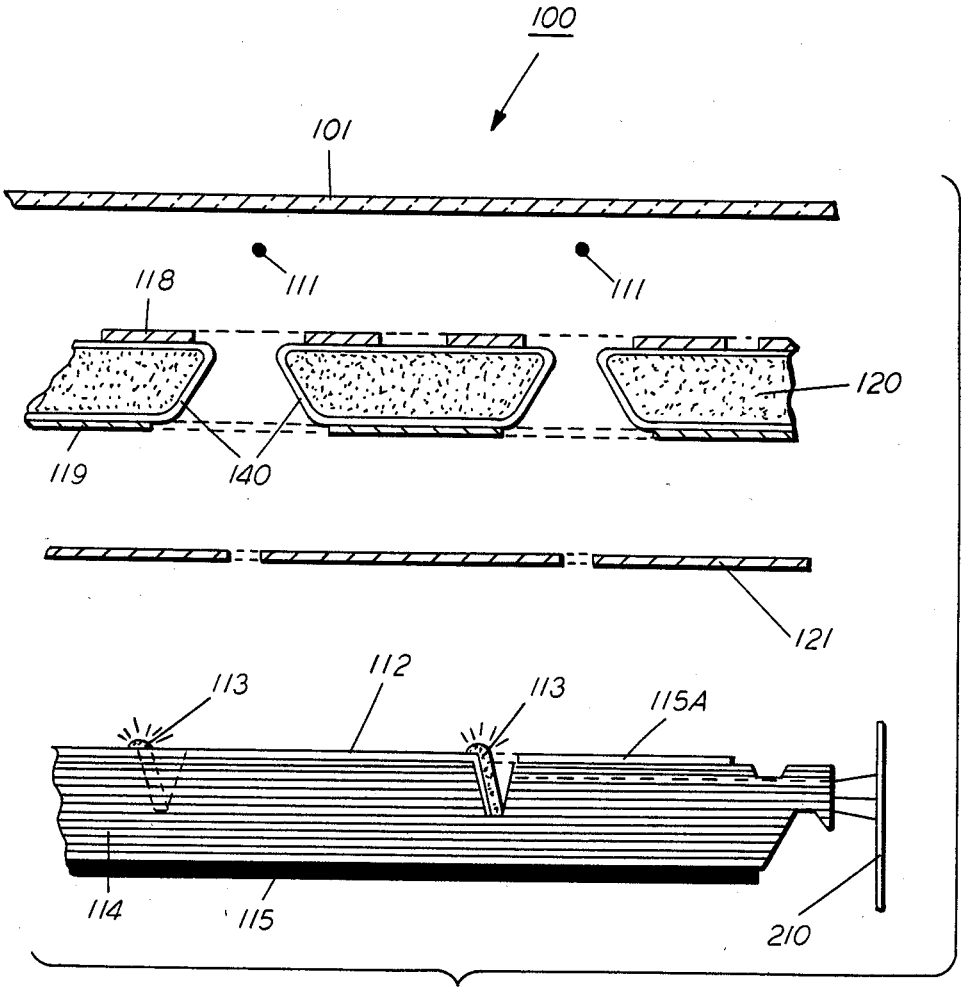
FIG. 1 is a partial side view of one embodiment of the vacuum fluorescent device of the present invention incorporating a fiber-optic plate.
Figure 2:
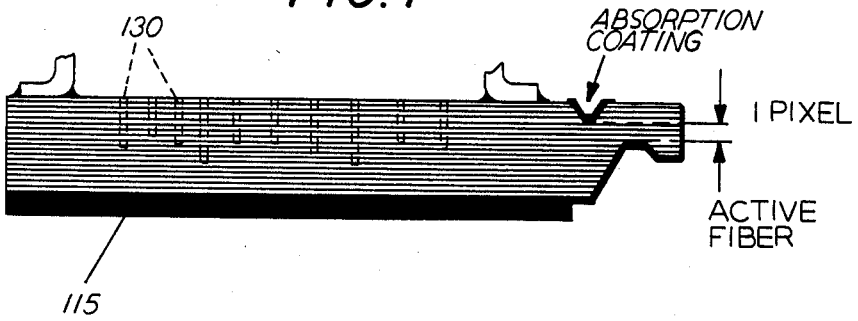
FIG. 2 is a side view of the fiber-optic plate showing laser machined holes at various depths thereof.

While the present invention will be described in a preferred embodiment, it will be understood that it is not intended to limit the invention to that embodiment. On the contrary, it is intended to cover all alternatives, modifications and equivalents as may be included within the spirit and scope of the invention as defined by the appended claims.

The device that encompasses the present invention will now be described in detail with reference to the Figures where like reference numerals will be employed throughout to designate identical elements. Although the device for receiving electrical signals and generating an optical output is particularly well adapted for use in a printing machine, it should be evident from the following discussion that it is equally well suited for use in a wide variety of applications and is not necessarily limited to the particular embodiment disclosed.

In copending U.S. application Ser. No. 605,728, a uniquely constructed vacuum fluorescent (VF) printing device with many controllable light emitting elements (segments) is disclosed for use as an image generating device in conjunction with light sensitive recording media in order to create electronically generated images on that medium. The device contains 4096 elements in a $16 \times 256$ matrix addressable array, 16 rows and 256 columns covering a photoreceptor width of 10.24 inches. This requires only 272 control line feedthroughs which can be matrix controlled in a straightforward conventional way and can be easily incorporated in a tube envelope a little more than 12 inches in length. Light emitting segments are laid out in a skewed two-dimensional array so that there is enough room between elements to allow fabrication of the grid structure controlling the electron-beam of each element. Practical considerations limit the spacing of segments to approximately 15–20 mils.

VE displays are actually high vacuum cathode ray tubes with multiple beams in which electrons emitted from a hot filament spanning the device can be gated by a grid structure to selectively excite segments of a phosphor coated anode screen. It can be appreciated that matrix control is necessary when the total number of connections needed for direct switching of 4000 to 6000 elements is considered. Many displays and print bar technologies rely on non-linear behavior or incorporate external components to provide matrixing capability.

Vacuum tubes with multiple grids have this capability built in; if any grid in the path from the cathode to anode is biased off, no current can flow and, in the case of the CRT or VF device, no light will be generated. In these devices grid currents are normally very small and very little grid drive power is required. Since the actual amount of anode current is a continuous function of both grid potentials, the control voltage swings needed to provide strictly logical behavior depends on the particular device configuration and are a function of the grid spacings and shapes and the anode potential used. In general, the grid nearest the cathode is the most sensitive with the greater voltage swings being required for successive grids in the path toward the anode. Raising the anode potential also increased the minimum voltage swings required for the system to behave as a logic circuit.

Referring now to FIG. 1, and in accordance with the present invention a vacuum fluorescent device or optical light bar 100 is shown with many controllable light emitting phosphor elements positioned within a fiber-optic plate 114 on a transparent tin-indium oxide anode 112. An opaque layer 115A is applied on the open portions of the plate 114 to minimize the light entering the fiber-optic plate except at points 113. This light blocking layer may be applied either over or under transparent coating 112 but should be itself conductive if it is applied over coating 112. A second absorbing coating is placed on the back of fiber-optic plate 114 to absorb stray light generated at points 113 that is not being conducted along the fibers to the useful image. Also, the fiber-optic plate contains a small proportion of absorbing fibers distributed through its bulk during manufacture to reduce stray light and improve image contrast.

The anode could also be a screen covered by fluorescent material, a solid anode covered with fluorescent material or anode segments positioned on a support substrate and covered with a fluorescent substance. Alternatively, the anode could be a thin phosphor layer of fluorescent material on a conducting substrate, a conducting equipotential coating on an insulating substrate that is covered with fluorescent material, or conducting anode areas positioned on an insulating anode substrate and covered with a fluorescent substance. In each of these instances the phosphor layer can be either a continuous or a segmented coating. On the grid structure, orthogonal conductive stripes 118 and 119 with attached electrical feed throughs are arranged in rows and columns respectively, forming an x-y matrix. With this arrangement, the anode phosphor layer will be excited by the current of an electron-beam passing through an aperture that has both row and column grids biased to conduct at that intersection. All other elements will remain "OFF".

With one row grid held "ON", any number of elements along that row can be simultaneously excited by selecting the corresponding columm grids. This mode of operation is important because more time is made available for exposing each point in the image when columns can be modulated simultaneously by parallel circuitry than is available when each element has to be excited by individual circuitry. At any one time, 256 photorecetpor pixels are addressed and may be exposed, depending on the image data which is presented to the column grids.

The optical imaging bar 100 includes a grid structure comprising a grid plate 120 consisting of an insulating sheet with an array of apertures having conductive patterns on both sides and a conductive sheet 121 forming a screen having the same pattern of holes. The grid plate 120 is a Corning Photoform Opal lithium based glass ceramic product. This Photoform glass product has the property of being easy to fabricate in a flat platform configuration with complex holes. The screen is maintained at any positive voltage with the optimum value of +5 to +50 volts and is supported by a superstructure (not shown). A cover plate 101, shown in FIG. 1, provides with fiber-optic plate 114 a high vacuum hermetically sealed unit. The optical imaging bar 100 is maintained air free by the use of a conventional getter. The grid plate is perforated with 4096 apertures in a staggered 256 column by 16 row array. Conductive traces are formed on both sides of the grid plate to make x-y connections to all of the apertures. One side of the plate has 16 traces running the length of the plate, each electrically connected to 256 apertures, the other side has 256 traces across the width of the plate connecting 16 apertures each.

Optical light bar 100 is matrix controlled according to the truth table shown below and functions as a logical AND gate provided the control voltages $G_m$ and $G_n$ swing widely enough. In the table $G_m$ is one of grids 118, and $G_n$ is one of grids 119.

TRUTH TABLE

| $G_m$ | $G_n$ | $OUTPUT_{m,n}$* |
|---|---|---|
| low | low | off |
| low | high | off |
| high | low | off |
| high | high | on |

*for example,
Grids $G_m$: −2 volts = low; +2 volts = high
Grids $G_n$: −5 volts = low; +20 volts = high This strictly logical behavior provides a distinct advantage over other matrix controlled devices, such as, liquid crystal displays. In those devices, control is based on the sharp voltage threshold of a material property of the light modulating or emitting material that is positioned between electrical control elements. The state of the material depends only on the voltage difference between the control elements. In the present invention control is by the electrical activation of two or more juxtaposed electrical control elements where the potential of each with respect to the electron source must be within a certain range. In the present invention, 256 grids $G_m$ are designed to be driven by relatively low TTL logic (up to 30 volts using ordinary open collector chips, or up to 80 volts using special display-driver chips) and are operated at low current levels. The binary number 256 was chosen because it represents a significant reduction in the number of necessary external interconnections leading to a compact package and is a convenient number for the design of the computer controlled drive circuitry. In this grid-grid multiplexing arrangement with the image data presented on the column grids, the 16 rows of the grids are energized sequentially one at a time. The imaging data, presented at the 256 column grids, determines which of the apertures in the energized row can pass electron current to the phosphor below. It is the phosphor on the anode which generates the useful light output pattern from the device, one row of excited elements at a time in succession. Since the system has only 16 rows the associated circuits driving each row can be fabricated from discrete components if necessary, permitting but not necessarily requiring the use of tailored switching circuit designs that can deliver higher voltages and currents than currently available from integrated chips.

In operation, a conventional data source such as a computer sends appropriate video data to a multiplexer/controller constructed of conventional integrated circuit chips. The controller then sorts the video data input signals and with the proper timing, sends the correct signals to a column buffer/driver and to a row decoder also constructed of conventional integrated circuit chips. The row decoder keeps track of which row is active and signals the row buffer/drivers accordingly to deliver the proper row selection potential swing. Electrical power is supplied to the andoe by way of a high voltage feed through.

If only a few hundred volts are needed on the anode, the second grid or conductive traces can be eliminated and the anode segments themselves connected to form 16 rows, rather than be part of an equipotential surface as implied above; the row drivers would then switch the anodes rather than a second grid. This is the standard configuration found with vacuum fluorescent devices that are designed to operate at relatively low voltages. In this configuration, the drivers must supply the full operating anode current as well as the voltage swing. With two grids, only a relatively small grid current must be supplied. However, it has been found that in order to sufficiently expose a photoreceptor in a conventional xerographic machine, relatively high anode voltage will be needed even with efficient light coupling optics. This makes the two-grid structure as shown in FIG. 1 preferable since the anode segments form a single equipotential anode operated at constant high voltage which does not have to be switched. The anode supply in this embodiment is introduced through a separate high voltage feed through spaced away from other components.

When the optical bar is operated in the preferred embodiment at a very high anode potential, the voltage swing needed for cutoff of either grid will be proportionately larger. This could cause severe operational problems for compact VF configurations where the grid-anode separation is minimal. However, the voltage swings needed for the control grids can be substantially reduced by placing equipotential screen grid 121 between the second grid 119 and anode 112, effectively shielding the region near the grids from the anode accelerating fields. The control portion of the electrode structure then behaves as if the screen were the anode. Electrons gated to the screen pass through strategically located etched holes and are strongly accelerated to excite the phosphor coated anode which is at a much higher voltage. It should be understood that the generated light from bar 100 could be imaged on a photoreceptor either from the front or back surface. The grid structure itself could conceivably get in the way and prevent using the light emitted from the front of the device if its apertures were too small. But, in practice, apertures through which electrons pass are easily made to focus the electron beam on the target by applying an appropriate bias voltage. With this mechanism, large openings are used in the control structure while still concentrating the electron beam on the target. The optimum configuration is a compromise with apertures large enough so that they do not block light yet small enough to permit low voltage beam control.

A vacuum fluorescent device containing a large number of electronically controllable light sources in some fixed pattern is not by itself sufficient to make a useful print bar apparatus. In conventional vacuum fluorescent tubes, practical considerations limit the closest physical spacing of individually controlled light emitting segments to approximately 15–20 mils. With this limitation, placing all 4096 segments of print bar 100 in a single space at about 400 to the inch is precluded. However, if the segments are arranged in a rectangular array located 40 mils apart in both x and y directions forming an active area of 0.60 inches in width and 10.24 inches in length, and the array is inclined by 40 mils with respect to the direction of photoreceptor motion, the minimum spacing requirements for the anodes as well as the grids and terminals are easily accommodated. Guiding the light from the anode area of the light bar toward photosensitive surface or photoreceptor 210 is fiber-optic plate 114.

In further reference to FIG. 1, the inside surface 140 of the apertures in insulating plate 120 and the area surrounding each hole is coated with material that is slightly conductive, such as tin-indium oxide or a resistive cermet preparation, forming a layer with resistivity in the range of 10 to 500 thousand ohms per square. The function of this coating is to drain away any charge that may otherwise accumulate on exposed insulating surfaces within or near the apertures. If an aperture wall becomes charged, the electric field distribution is changed which greatly alters the electron trajectories through the aperture and therefore the structure's electron beam modulation characteristics. Spaces between traces on the surface of the control structure also have the slightly conducting coating to prevent charge accumulation there.

The conduction via the coating between adjacent traces on either surface, and between traces on opposite sides of the plate through the apertures represents a resistive load to the grid drive circuits. The small current flow in the coating due to potential drops between grids does not affect electron trajectories or switching characteristics of the device in any way. However, the coating should be made as resistive as possible to minimize ohmic heating in the coating and limit the load seen by the drive circuits to a reasonable value.

Besides providing a leakage path to ground for stray charge, the resistive coating serves to stabilize the potential distribution in the interior of the apertures against the effects of space charge at high beam current and allows slightly larger apertures to be used with a given control voltage swing. In addition, tailoring the shape of the apertures, i.e. making them conical for example, provides some degree of control on their focusing properties because the field distribution in the interior of the apertures is modified.

Figure 3:
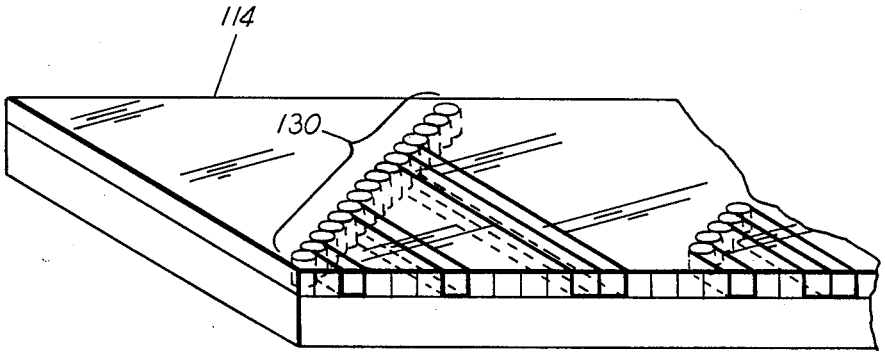
FIG. 3 is a partial isometrical view of the fiber-optic plate of the present invention showing a staggered pattern of holes matching the layout of the light emitting structure of FIG. 1.
Figure 4:
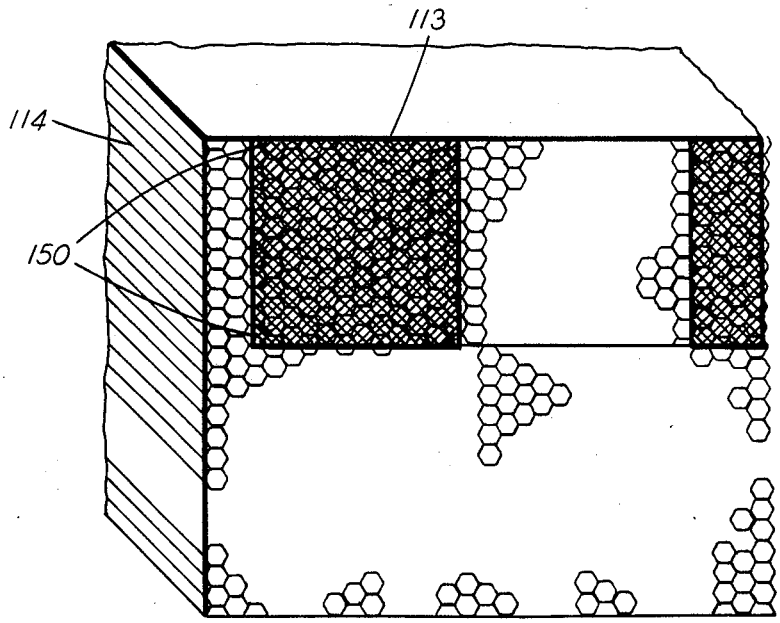
FIG. 4 is an enlarged partial view of a group of fibers in the fiber-optic plate of FIG. 3.

In more particular reference to the present invention and fiber-optic plate 114, a structure is shown in FIGS. 1–4 that improves the light collection efficiency from phosphor elements while simultaneously removing the necessity to store and electronically preformat, or prescramble, the data for more than one line of the image at a time. With fiber-optic plate 114, each pixel is coupled through many paths by a group of fibers that make up a "pixel or exposure conduit" as shown in FIG. 4. The plate is easily mass produced because there is no need to precisely position individual fibers in the plate since the fibers that belong to a specific pixel conduit will be determined by the way the plate is cut assuming the fibers are all parallel. Individual fibers not belonging to a group forming a conduit are unused. Conduit boundaries are statistical in nature because of the random positioning of individual fibers and boundries between adjacent groups may include fibers common to both or unused by either group. Since the fibers are small compared with the size of a pixel, any of these conditions are aceptable.

The preferred embodiment of the present invention comprises a two-layer plate made of a thin glass fiber-optic layer 114, sawed lengthwise from a boule parallel to the axis of the fibers and bonded to sheet of light-absorbing material 115. The fiber-optic layer can be thick enough to be self supporting in which case the light-absorbing layer need only be ordinary black paint. At the other extreme, a fiber-optic layer with a thickness equal to the pixel dimension is bonded to a thicker supporting sheet of light-absorbing glass 115. The function of the light-absorbing substrate is to attenuate light that is not captured within the acceptance cone of the fibers and does not contribute to the useful image. Unless removed, as appreciable fraction of this light finds its way to the photoreceptor 210 and creates unacceptable background. This is important because of the short distance likely between phosphor and photoreceptor and is especially important if an absorptive mechanism (EMA or extra mural absorption) is not incorporated in the fiber structure itself. It has been found that over short distances, an absorbing substrate adjacent to a thin fiber-optic section is much more effective in removing unwanted stray light than conventional EMA methods.

The fiber layer contains an array of 4096 ultrasonically machined blind holes 130 in a staggered pattern matching the layout of the electron gating structure, as shown in FIG. 1 through FIG. 4. The opaque blocking layer 115A is applied before the holes are machined so that light can enter the plate only through the holes. With this arrangement the transparent conductive coating 112 is applied over layer 115A. The ultrasonic tool can be preformed to generate any desired hole shape in order to maximize efficiency, for example a rectangular slot with one straight wall for the output fiber bundle and one angled wall on which the phosphor is deposited. Alternatively, blind holes can be cut in the surface of a fiber-optic wafer in this configuration using commercially available laser drilling equipment. Depending on the power used, the resulting holes are from 1.5 to 5 mils in diameter with an aspect ratio of from 2 to 10 (2 to 10 times as deep as wide). The laser method can be made to form elongated holes or slots, as well as round holes. The slotted shape may offer improved or more reproducible hole definition; a pilot hole is drilled first and the finished surface formed to one side leaving a clear escape path for ablation products. As an example of still another method, holes of approximately the correct size and aspect ratio can be formed in fiber-optic plates with hot tungsten wires which may also have a special cross sectional shape. The wires are heated above the glass melting point, inserted into the glass surface and withdrawn leaving relatively well defined holes.

The surface of the wafer, including the walls of the holes, is coated with a transparent conductive layer such as indium-tin oxide. If the light blocking layer on the wafer surface between holes is a conductor as well as being opaque, such as evaporated or sputtered metal, the indium-tin oxide transparent conductive layer can be of higher sheet resistivity because the electron path within the transparent conductive layer is very short. The surface of the substrate and the phosphor coated holes can be operated either as a single equipotential surface, or the holes may be arranged in separate electrical groups by appropriate photolithographic techniques. A thin uniform layer of fine phosphor particles is then deposited in the holes either preferentially on one side wall or evenly on all sides, as shown in FIG. 1. Electrophoresis is the preferred method of applying phosphor evenly on all sides because it reproducably yields very thin uniform deposits. The process is also very fast and clean since no binder is needed. Thick phosphor coatings appear much brighter when viewed from the side struck by the exciting electron beam so there is an advantage in depositing phosphor only on the wall opposite to the output fibers. Several techniques can be used to coat only one wall of the holes as shown in FIG. 1. The simplest method is settling the phosphor from a liquid suspension with the substrate 114 tipped up to nearly a vertical position.

The total structure as seen in FIG. 1 is frit-glass sealed with a cover glass 101. The assembly is then pumped, baked, sealed and gettered using the same techniques and procedures as standard VF tubes.

Semi-automatic fixturing laser "trimming" of the finished plate adjust the relative brightness of individual elements. This is accomplished by ablating away small amounts of phosphor or cutting away a mask blocking some of the output and introduced for this purpose at the holes 113 or output ends of the fibers or exposure conduits. If the trimming is done at the output end of the fibers, small position errors from fiber skew can be corrected at the same time. This can be done in a vacuum system fixture before assembly or after the device is assembled and sealed off. The advantage of trimming before sealing is that it permits rejects to be reworked, cutting down on waste.

In FIGS. 3 and 4 fiber-optic plate 114 is shown with a staggered array of holes 130 that match the apertures of the electron gating grid structure. The holes are covered on their inside surfaces as in FIG. 4 with a fluorescent substance that once excited by electrons from cathodes 111, give off light that is transmitted through exposing elements 150 in a linear direction to an edge of wafer 114 that is adjacent a photosensitive member. As a result, the photosensitive member will be exposed in imagewise configuration.

Figure 5:
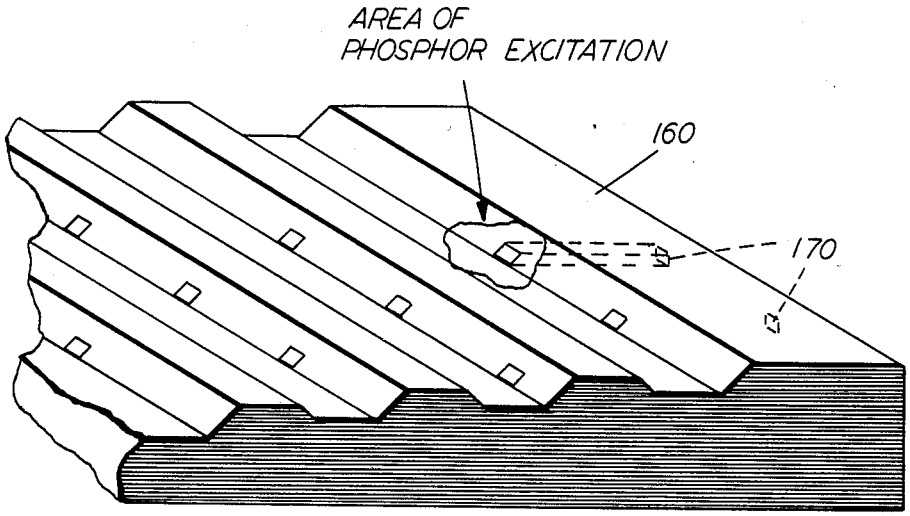
FIGS. 5 and 6 show an alternative embodiment of the present invention in the form of a multiple leveled fiber-optic structure.
Figure 6:
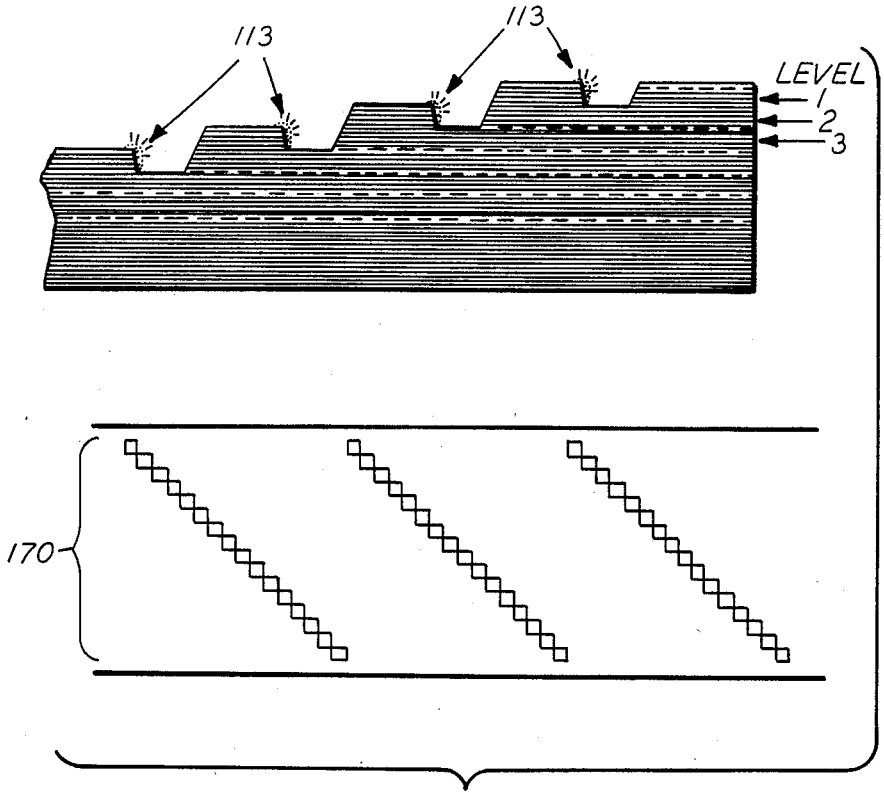

An alternative to drilling holes is shaping the exposed fiber surface to form a multiple level or tiered structure as shown in FIGS. 5 and 6. This can be done efficiently with diamond form-grinding fixtures, for example, where the entire surface is formed at one time to very high precision. The tiered surface allows access to multiple levels within the fiber plate. A thin evporated metal coating provides an opaque, electrically conductive coating 160 over the entire surface. Optical ports 170 can then be formed in this coating in the desired staggered pattern. The area behind the ports is shaped to provide an inclined wall on which the phosphor 113 is deposited which increases the light collection efficiency of the structure. The ports can be etched or cut by laser machining and the same type of automatic fixturing mentioned above employed to provide pixel-to-pixel uniformity.

Figure 7:
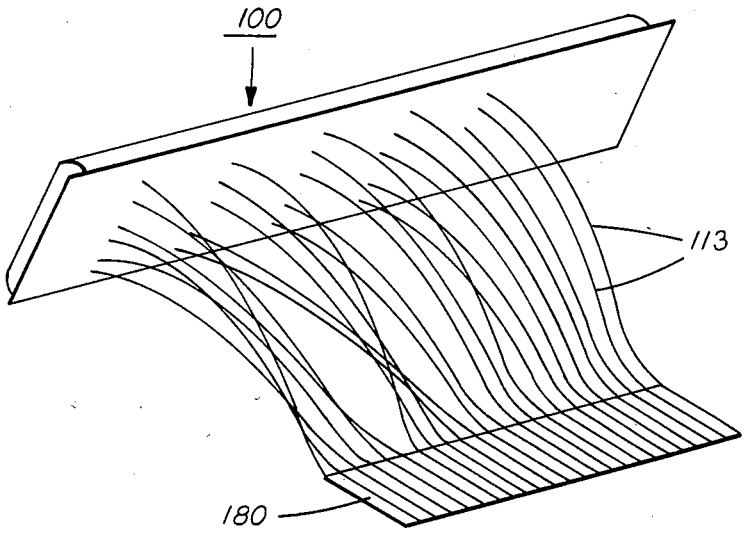
FIGS. 7 and 8 show an alternative embodiment of the present invention in the form of an array of individual light-pipes incorporated directly into the vacuum fluorescent device.

An alternative embodiment of a light coupling method and apparatus in accordance with the present invention includes a light-pipe array that conducts light from elements 113 directly to a photosensitive surface by means of tiny light-pipes positioned one per element as shown in FIG. 7. The light from elements 113 goes to individual light pipes 180 bonded to a supporting glass substrate or conventional fiber-optic faceplate. Like the individual fibers in the preferred embodiment, these pipes 180 work by total internal reflection and can be fabricated in any size and cross sectional shape. It should be understood that in addition to single light-pipes or bundles of filaments leading light directly from the phosphor inside the vacuum envelope to the photosensitive surface, a fly's-eye lens array could be used to couple the light from the VF device to an array of light-pipes, with both the fly's-eye lens array and the light-pipes wholly external to the vacuum. Each fly's-eye lens would conduct the exposing light from a small area on the phosphor coated anode through the glass vacuum envelope to the input end of a light-pipe output "bar" where the output ends are arranged side-by-side in a uniform tightly packed linear array. For a 400 pixel per inch resolution system, the light-pipe ends would be 2.5 mils square. Since the lenses and light pipes are not in the vacuum, materials other than glass can be used in their fabrication.

Figure 8:
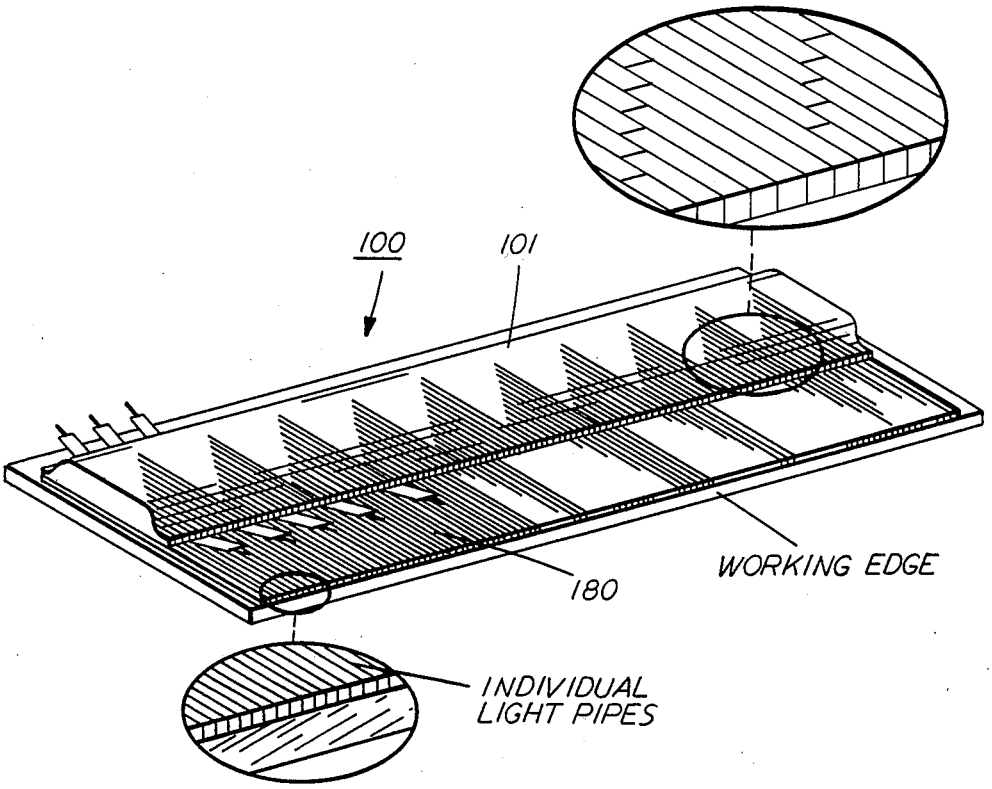

An equivalent structure to the preferred embodiment can be formed on a flat substrate of suitable material by bonding pixel-sized light-pipes to the surface in a uniform side-by-side array as shown in FIG. 8. Cutting through a light-pipe as shown in the enlargement of an area inside transparent cover glass 101, at any specific point permits light to be introduced at that point just as if it were the end of the light-pipe. Once introduced, light is conducted to the output ends through the vacuum seal essentially without loss. No interaction takes place with the ambient unless the light-pipe is cut or damaged in a way as to provide a coupling mechanism. The points at which the light pipes are cut are made to match the apertures of the overlying grid array while the ensemble of light-pipe output ends form a linear array of exposing light sources for printing purposes as shown in the area enlargement of individual light-pipes. The disadvantages of the individual fiber designs, compared with the preferred embodiment utilizing a drilled fiber optic plate, is the awkwardness in handling and assembling tiny fibers and the bundles of fibers that must be put together to fabricate the device. Like the preferred embodiment, the layout of the optical fibers conducts light from a two dimensional anode surface to a contiguous output line eliminating the need to electrically preformat and store large areas of the image for printing which is necessary for configurations without this function. The fiber optic structure replaces the anode substrate of basic VF devices and phosphor is deposited directly on (or in very close proximity to) the cut ends of the light-pipes themselves within the vacuum envelope. The light-pipes are brought outside the envelope through the frit-glass vacuum seal bonding the substrate to the cover glass. This arrangement improves the light collection efficiency significantly because of the proximity of the phosphor to the pipe ends. Compared with conventional optics, the transfer efficiency of the fiber-optic arrngements is very high; standard N.A. 0.66 fiber plates are equivalent to an F:0.56 lens. Individual pipes can be severed where desired by several methods including chemical etching, machining with diamond tools (gang saws), ultrasonic machining with formed tools made by electric-discharge machining (EDM), and laser ablation.

Even though this invention is described by reference to light bars it should be understood that some of the methods involved can be used for other applications as well, for example, cathode ray tubes currently have a complete fiber optic facing. This is wasteful because only a narrow band of fibers are used for image formation. CRT's with a narrow band of usable fibers have been built but are costly because of the expense required to make them. Fabrication requires grinding and polishing a thin fiber optic wafer parallel to the fibers and bonding this wafer between plain glass plates to form a sandwich from which faceplates can be sawed. After being polished, these are then bonded to the vacuum bulb. To avoid processing thin sections which are hard to handle the following methods could be used: (1) Photoresist techniques can be used to form a slit on one end of the oversize fiber sheet (after it is bonded to form a composite faceplate) to define the extent of the optically active fibers. The slit can be formed on either end of the bundle. If placed on the vacuum side in the finished tube, it will be protected from mechanical damage but must be vacuum and phosphor compatable. If outside the tube, it may be damaged but can be repaired or replaced at any time without the need to break the vacuum seal. (2) Grooves machined partway into both sides of a fiber-optic blank with a diamond saw will sever fibers that are outside the intended active area, thereby preventing optical transmission. If the grooves are staggered longitudinally they can be introduced without structually weakening the blank significantly. The kerf can be painted with an opaque coating for good contrast or can be left open if the kerf is wide enough. The advantage of the kerf method over the photoresisting method is that the results are permanent and only simple mechanical fixturing is required. With either of these methods, the alignment of the fibers with respect to the finished faceplate is not essential.

In summary, an optical light bar is disclosed that receives electronically generated signals from a computer or other digital output sources and converts them into light transmissions that expose a photosensitive member in imagewise configuration. The light bar includes wire filaments, first and second multiplexed/control grids, a staggered matrix of addressable phosphor coated anode elements positioned on a support surface and an optional equipotential screen grid positioned between the second grid and the anode elements. An improvement in the form of a fiber-optic plae is positioned to receive light given off by the phosphor elements when they are excited by electron emissions and transmits the light in a linear direction through pixel conduits to expose a photosensitive member in imagewise configuration.

What is claimed is:

1. A vacuum fluorescent printing device adapted for use in conjunction with a light sensitive recording media in order to create in imagewise configuration electronically generated data, comprising in combination:

a plurality of cathode filaments;

a control grid;

a matrix of addressable areas on an anode covered with phosphor such that as said phosphor areas are excited by electrons from said cathode filaments through said control grid a high resolution array of precisely defined light is generated and directed toward said light sensitive recording media; and a fiber-optics plate adapted to support said phosphor coated anode and transmit the light from said phosphor areas to said light sensitive recording media in a linear array.

2. The vacuum fluorescent printing device of claim 1, wherein said addressable phosphor coated anode areas are arranged in a two-dimensional array.

3. The vacuum fluorescent printing device of claim 1, wherein said fiber-optics plate includes a plurality of exposure conduits.

4. A vacuum fluorescent printing device of claim 3, wherein said plurality of exposure conduits are arranged in exposure conduit groups.

5. The vacuum fluorescent printing device of claim 4, wherein said exposure conduit groups transmit light out edgewise of said fiber-optics plate.

6. The vacuum fluorescent printing device of claim 1, wherein said fiber-optics plate is sawed lengthwise from a boule parallel to the axis of its fibers.

7. The vacuum fluorescent printing device of claim 1, wherein said fiber-optics plate translates a two-dimensional pattern of light input into a one-dimensional pattern of light output.

8. The vacuum fluorescent printing device of claim 1, wherein said fiber-optics plate comprises a tiered structure that allows access to multiple levels within said fiber-optics plate.

9. A vacuum fluorescent printing device adapted for use in conjunction with a light sensitive recording media in order to create images from electronically generated data, comprising in combination:

a plurality of cathode filaments;

a control grid;

an array of addressable phosphor areas located on an anode such that as said phosphor areas are excited by electrons from said cathode filaments through said at least one control grid light is emitted from said phosphor areas; and a light pipe array adapted to receive the light emitted from said phosphor areas and conduct said light edgewise to precisely define locations arranged in a high resolution array adjacent said light sensitive recording media for the purpose of exposure.

10. A method for printing with a vacuum fluorescent printing device adapted for use in conjunction with a light sensitive recording media in order to create in imagewise configuration electronically generated data, comprising the steps of:

providing a plurality of cathode filaments;

providing at least one control grid;

providing a matrix of addressable areas on an anode covered with phosphor such that as said phosphor areas are excited by electrons from said cathode filaments through said control grid a high resolution array of precisely defined light is generated and directed toward said light sensitive recording media; and providing a fiber-optics plate adapted to support said phosphor coated anode and transmit the light from said phosphor areas to said light sensitive reading media in a linear array.

11. The vacuum fluorescent printing device of claim 9, wherein said light sensitive recording media is adapted for movement.

12. The vacuum fluorescent printing device of claim 11, wherein said light pipe array has holes therein that have individually varying depths in order to compensate for the movement of said light sensitive recording media.

13. The vacuum fluorescent printing device of claim 12, wherein said light sensitive recording media is a photoreceptor.

14. The vacuum fluorescent printing device of claim 13, wherein light is generated within said holes.

15. An active light bar that creates precisely controlled marks on a photoreceptor from a digital electronic bit stream that represents a document to be copied, comprising in combination:

a plurality of cathode filaments;

a control grid;

a matrix of addressable areas on an anode covered with phosphor such that as said phosphor areas are excited by electrons from said cathode filaments through said control grid a high resolution array of precisely defined light is generated and directed toward said light sensitive recording media; and a fiber-optics plate adapted to support said phosphor coated anode and transmit the light from said phosphor areas to said light sensitive recording media in a linear array.

16. A vacuum fluorescent printing device adapted for use in conjunction with a light sensitive recording media in order to create in imagewise configuration electronically generated data, comprising in combination:

a plurality of cathode filaments;

at least one control grid;

a matrix of addressable areas on an anode covered with phosphor such that as said phosphor areas are excited by electrons from said cathode filaments through said control grid a high resolution array of precisely defined light is generated and directed toward said light sensitive recording media; and a fiber-optics plate adapted to support said phosphor coated anode and transmit the light from said phosphor areas to said light sensitive recording media in a linear array.

17. An active light bar adapted to create precisely defined and controlled marks on a photoreceptor from a digital electronics stream that represent a document to be copied, comprising in combination:

a plurality of cathode filaments;

a control grid;

a matrix of addressable anodes convered with phosphor such that as said phosphor is excited by electrons from said cathode filaments through said control grid a high resolution array of precisely defined light is generated and directed toward said light sensitive recording media; and a fiber optics plate adapted to support said phosphor coated anodes and transmit the light from the phosphor coated anodes to said photoreceptor, said fiber optics plate having precisely defined holes therein for supporting said matrix of addressable anodes.

18. The active light bar of claim 17, wherein said holes are V-shaped with said matrix of addressable anodes being positioned on one surface of said holes in a facing position to said photoreceptor.

19. The active light bar of claim 18, wherein said fiber optics plate includes a plurality of horizontally skewed pixels.

* * * * *